US005651720A

United States Patent [19]

Shinomoto et al.

[11] Patent Number: 5,651,720

[45] Date of Patent: Jul. 29, 1997

[54] BORE SIZE CORRECTING APPARATUS

[75] Inventors: Masami Shinomoto; Chuichi Sato, both of Kanagawa, Japan

[73] Assignee: NSK Ltd., Tokyo, Japan

[21] Appl. No.: 447,042

[22] Filed: May 22, 1995

[30] Foreign Application Priority Data

May 20, 1994 [JP] Japan ..... 6-130945

[51] Int. Cl.[6] ..... B24B 49/00

[52] U.S. Cl. ..... 451/8; 451/252; 451/51; 451/65

[58] Field of Search ..... 451/8, 51, 61, 451/119, 177, 252, 381, 504, 487, 65, 69, 143, 180, 52

[56] References Cited

U.S. PATENT DOCUMENTS

| | | | |
|---|---|---|---|
| 1,960,555 | 5/1934 | Sims | 451/504 |
| 2,135,884 | 11/1938 | Disco | 451/504 |
| 2,277,589 | 3/1942 | Hanson | 451/65 |
| 2,298,367 | 10/1942 | Glaude | 451/504 |
| 2,647,348 | 8/1953 | Hahn | 451/51 |
| 2,930,166 | 3/1960 | Muller | 451/8 |
| 3,774,349 | 11/1973 | Uhtenwoldt et al. | 451/25 |
| 3,924,355 | 12/1975 | Tatsumi et al. | 451/65 |
| 4,095,377 | 6/1978 | Sugita | 451/51 |
| 4,286,413 | 9/1981 | Axelsson et al. | 451/65 |
| 4,590,573 | 5/1986 | Hahn | 451/5 |
| 5,018,309 | 5/1991 | Wyss | 451/65 |

FOREIGN PATENT DOCUMENTS

| | | | |
|---|---|---|---|
| 319265 | 6/1989 | European Pat. Off. | 451/8 |
| 363165 | 4/1990 | European Pat. Off. | 451/119 |
| 52-26686 | 2/1977 | Japan | B23Q 15/04 |
| 52-97359 | 8/1977 | Japan | B21D 39/14 |
| 363295178 | 12/1988 | Japan | 451/8 |

*Primary Examiner*—James G. Smith
*Assistant Examiner*—Derris H. Banks
*Attorney, Agent, or Firm*—Sughrue, Mion, Zinn, Macpeak & Seas

[57] ABSTRACT

In a bore size correcting apparatus, a passing-through jig of an extended type lapping reamer in the bore size trimming device is passed through the bore surface of the workpiece machined by the bore grinding machine to correct the inner size of the workpiece, either one of the bore size to be corrected and a corrected bore size of the workpiece is measured by the bore size measuring device, a signal is outputted in accordance with the corrected bore size, and in response to the output signal, a machining command is supplied from the bore size control device to at least one of the in-process fixed-size control device and the external size control device. Thus, the bore size of the workpiece roughly manufactured by grinding can be precisely finished, with no skill, so as to have any optional set value, and the correction apparatus is also made compact and inexpensive.

8 Claims, 7 Drawing Sheets

BORE SIZE CORRECTING APPARATUS

BACKGROUND OF THE INVENTION

The present invention relates to an apparatus for correcting the bore size of a workpiece having a sectional cylindrical shape with high accuracy.

Conventionally, techniques for finishing the bore surface of a cylindrical workpiece has been of a type which the bore surface is ground using a grinding wheel. This grinding machining is carried out by the successive steps of fast approaching, grinding, spark-out and retracting of the grinding wheel. In such a grinding process, NC control function and in-process size measuring function are often appended in order to obtain the accurate bore size or inner diameter of a workpiece. As the case may be, a finishing process by a honing machine and a hand lapping machining process are carried out after the step of grinding.

However, a conventional grinding machine appended with the NC control function, the in-process size measuring function and the like raises a problem in which it is extremely difficult to hold the dispersion in the absolute value of a finishing size within 1 μmϕ because of various causes including abrasion of the grinding wheel, rotating accuracy of the workpiece, response speed of the machine and variation of an in-process gauge due to a grinding liquid.

In the case where it is desired by all means that the dispersion in size is decreased in the grinding process, the grinding speed is decreased and the time of spark-out is prolonged for the purpose of attaining slight improvements. This results in a long machining time and a high machining cost.

Accordingly, an effective method of solving the problems and an apparatus therefor have not been developed. Usually, in a post-step, a horning machine is introduced, the hand-lapping machining is performed or bore sizes are selected by skilled persons. For example, a tool as shown in FIG. 9 is used as a reamer (extended-type lapping reamer), but an amount of extension which defines the size of the workpiece is decided by skilled persons, which results in low accuracy in reproducibility. This usual process also results in expensive facilities and labor costs.

FIG. 9 shows an extended-type lapping reamer a having a reamer body b. The reamer body b has a plurality of slits d on the outer peripheral surface of a passing-through portion c on the front side. Super-abrasive (diamond or Cubic-Boron-Nitride abrasive) is applied to the outer peripheral surface. Within reamer body b, an axial body e is set by a set screw f. On the axial body e, a stop ring g, an extending piece h and an adjusting bolt j are mounted. The adjusting bolt j can be operated to move the extended piece h in an axial direction so as to vary the outer diameter of the passing-through portion c of the reamer body b.

Further, Unexamined Japanese Patent Publication No. Sho. 52-26686 discloses a bore grinding apparatus having an in-process fixed size control function of machining a workpiece while measuring its size and of continuing to machine the workpiece until the size reaches a predetermined value. But, since the apparatus does not include a correction device operated after finishing in-process control at all, it is impossible to solve the conventional problems as described above.

Moreover, Unexamined Japanese Patent Publication No. Sho. 52-97359 discloses an apparatus which forcibly passes a ball having a precise size through a path having a slightly smaller internal diameter than the diameter of the ball so as to determine the internal diameter of a pipe by the ball enlarging the internal diameter of the path with a small clearance. Since this apparatus does not have a device and an implicative function for trimming or adjusting the size after grinding at all, it is also impossible to solve the conventional problems.

SUMMARY OF THE INVENTION

The present invention has been completed in order to solve the problems associated with conventional apparatuses.

An object of the present invention is to provide a bore size correcting apparatus which can precisely finish the bore surface of a workpiece roughly manufactured by grinding, with no skill, so as to have any optional preset value, and which is also compact and inexpensive.

In order to attain the object, in accordance with the present invention, there is provided a bore surface grinder system which includes a bore grinding machine having an in-process fixed-size controlling device for controlling the bore size of a workpiece while relatively shifting a workpiece head rotatably supporting the workpiece and a tool head for supporting a machining tool machining the bore diameter surface of the workpiece in the radial and axial directions of the workpiece, and which includes a bore size correcting apparatus further correcting the bore size of the workpiece machined by the bore grinding machine, the apparatus further including a bore size trimming device for trimming the bore diameter of the workpiece by passing a passing-through jig through the bore surface of the workpiece machined by the bore grinding machine, the passing-through jig including an external diameter control device capable of varying the external diameter of the jig to be made larger than the bore size of the workpiece; a bore size measuring device for measuring either one of the bore sizes to be corrected and corrected of the workpiece and outputting a signal according to the corrected bore size; and a bore size control device for supplying a machining command to at least one of the in-process fixed-size control device and the external diameter control device.

In operation, a passing-through jig in the bore size correcting apparatus is passed through the bore surface of the workpiece after machined by the bore grinding machine to correct the bore size of the workpiece, either one of the bore sizes to be corrected and corrected bore size of the workpiece is measured by the bore size measuring device, a signal according to the corrected bore size is outputted, and in response to the output signal, a machining command is supplied from the bore size control device to at least one of the in-process fixed length control device and the external diameter control device.

In accordance with the bore size correcting apparatus of the present invention, the bore size of a workpiece roughly manufactured by grinding can be precisely finished, with no skill, so as to have any optional set value, and the correction apparatus is also compact and inexpensive.

The above and other objects and features of the present invention will be more apparent from the following description taken in conjunction with the accompanying drawings.

DETAILED DESCRIPTION OF THE PREFERRED EMBODIMENTS

Embodiments of the present invention will be described in detail with reference to the accompanying drawings.

Embodiment 1

Figure 1:
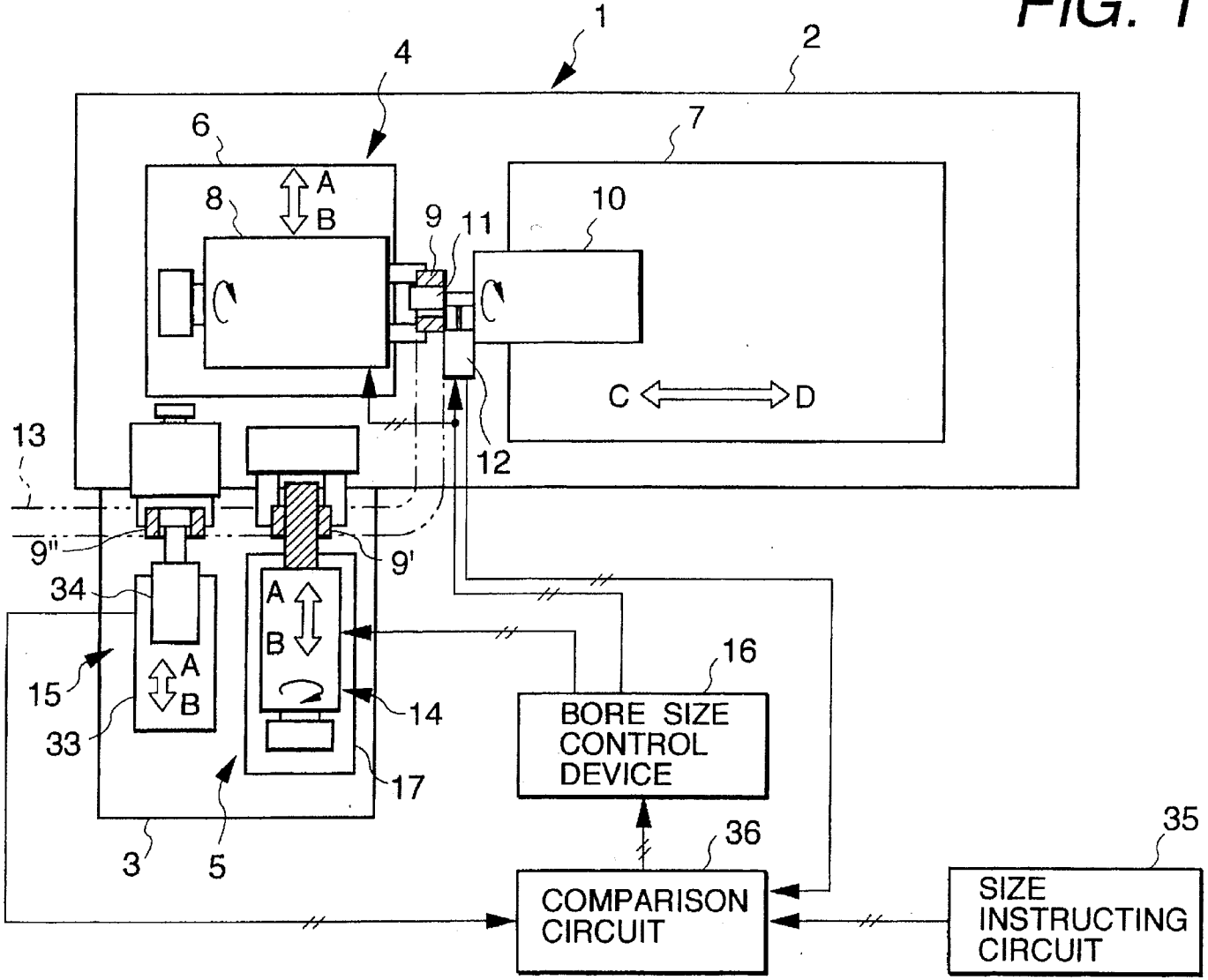
FIG. 1 is a block diagram showing a configuration of a bore surface grinder system equipped with a bore size correcting apparatus according to a first embodiment of the present invention.
Figure 2:
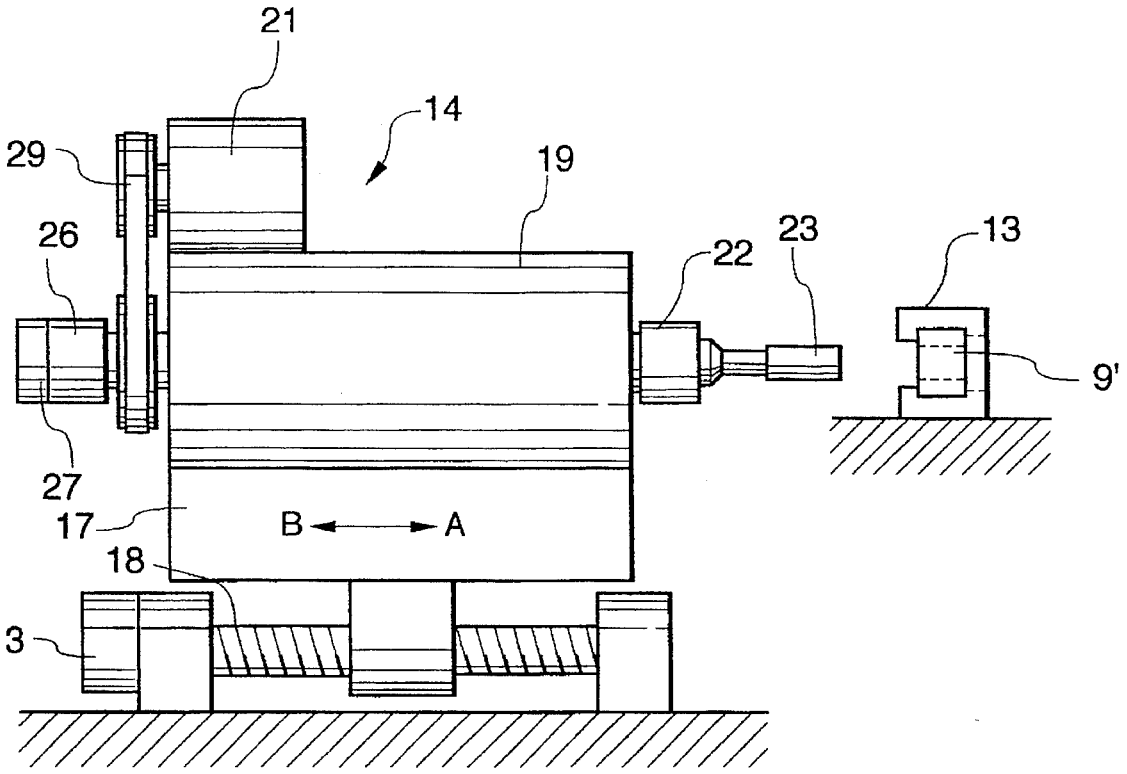
FIG. 2 is a side view showing the structure of the bore size correcting apparatus shown in FIG. 1.
Figure 3:
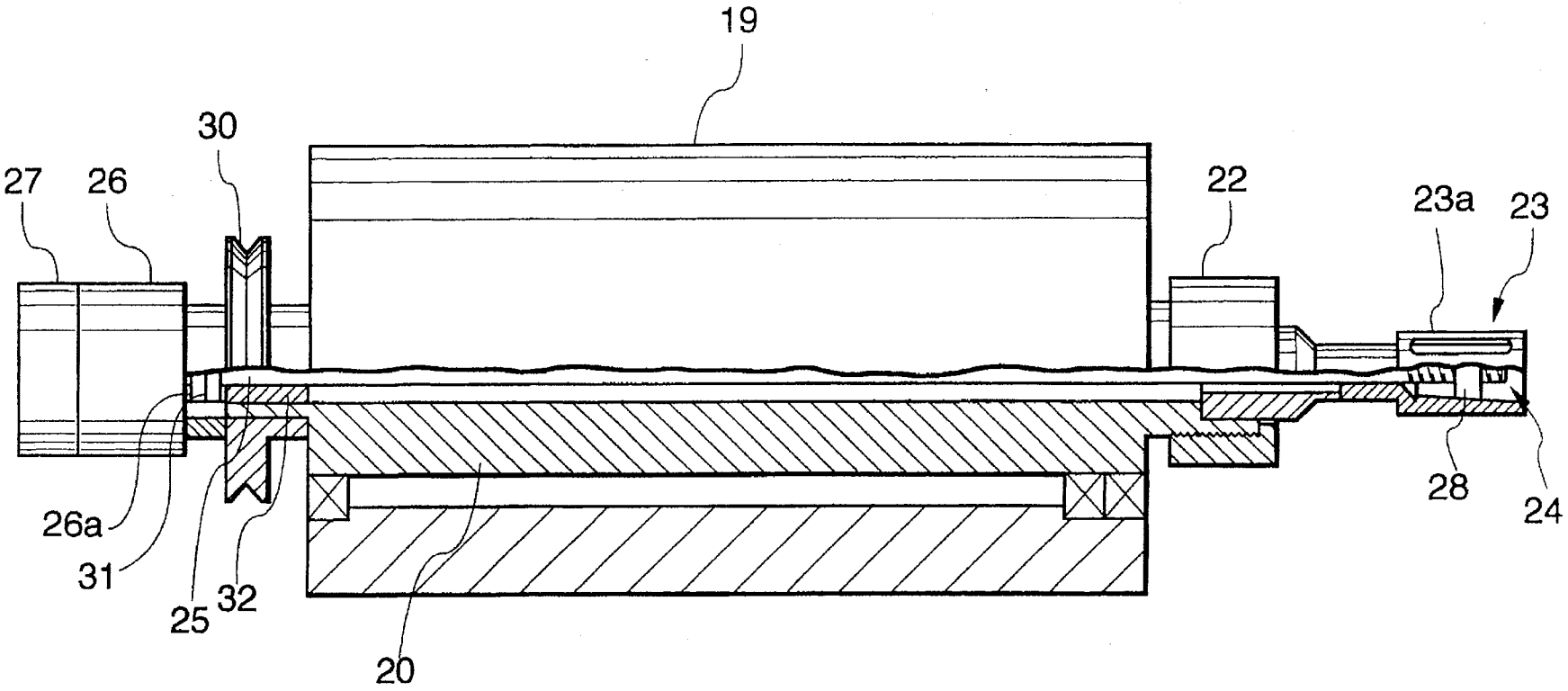
FIG. 3 is a half-broken side view with an enlarged main part of the bore size correcting apparatus.

Referring to FIGS. 1 to 3, an explanation will be given a first embodiment of the present invention. FIG. 1 is a block diagram showing a configuration of a bore surface grinder system equipped with a bore size correcting apparatus according to the first embodiment of the present invention. In FIG. 1, a bore surface grinder system 1 includes a first stand 2 and a second stand 3. A bore grinding machine 4 and a bore size correcting apparatus 5 are arranged on the first stand 2 and the second stand 3, respectively.

The bore grinding machine 4 includes first and second shifting stands 6 and 7. The first shifting stand 6 is mounted on the first stand 2 so that it is shiftable within a predetermined range in directions of arrows A and B. The second shifting stand 7 is mounted on the first stand 2 so that it is shiftable within a predetermined range in directions of arrows C and D which are orthogonal to the shifting direction of the first shifting stand 6. A workpiece head 8, which is mounted on the first shifting stand 6, serves to support a workpiece (an object to be machined) having a sectional disk shape. The workpiece 9 is rotated in a state where it is removably held at a holding portion provided at the tip of a spindle which is rotated by a motor (not shown).

A tool head 10 is mounted on the second shifting stand 7. The tool head 10 serves to support a grinding wheel (machining tool) 11 for machining the bore surface of the workpiece 9. The grinding wheel 11 is rotated in a state where it is removably held at a holding portion provided at the tip of a spindle which is rotated by a motor (not shown). An in-process gauge 12 serving as an in-process fixed-size controlling device is arranged between the first shifting stand 6 and the second shifting stand 7 on the first stand 2. The in-process gauge 12 operates to manage and control the bore size of the workpiece 9 and has a needle (not shown) in contact with the bore surface of the workpiece 9. The needle is shiftable in the radial and axial directions of the workpiece held at the holding portion of the workpiece head 8. If the bore size of the workpiece 9 is small, the needle is intermittently brought into contact with the bore surface to measure the bore size of the workpiece intermittently. If the bore size of the workpiece 9 is large, the needle is continuously brought into contact with the bore surface of the workpiece 9 to measure the bore size of the workpiece 9.

In the bore grinding machine thus structured, the bore surface of the workpiece 9 held at the holding portion of the workpiece head 8 is grind-machined to a predetermined size with the grinding wheel 11 under the feedback control of the bore size by the in-process gauge 12.

The bore size correcting apparatus 5 further corrects the bore size of a workpiece 9' rollingly transported through a workpiece transportation rail 13 having a slope, the workpiece 9' resulting from grinding-machining of the workpiece 9 by the grinding wheel 11 of the bore grinding machine 4. The bore size correcting apparatus 5 includes a bore size trimming device 14, a bore size measuring device 15 and a bore size control device 16.

Figure 9:
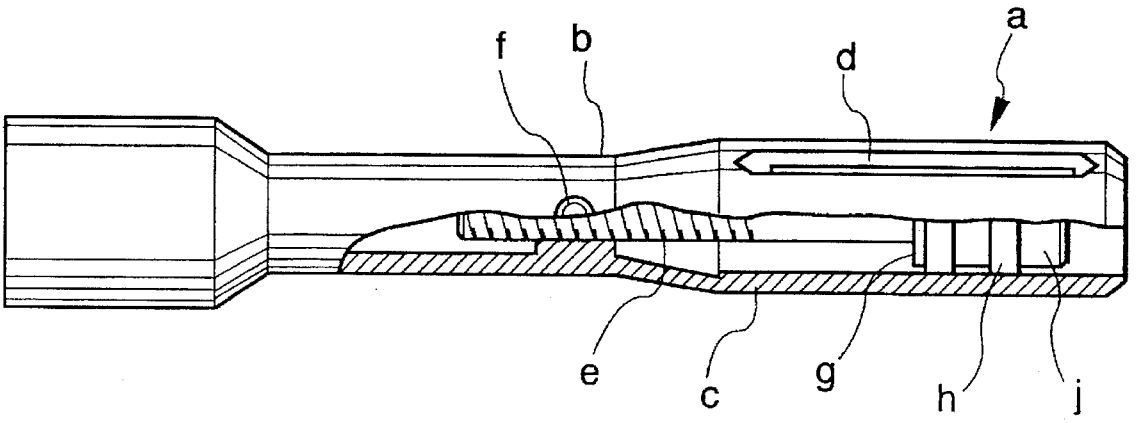
FIG. 9 PRIOR ART
FIG. 9 is a partially broken side view of a conventional extension lapping reamer.

The bore size trimming device 14 includes a third shifting stand 17 which is mounted on the second stand 3 so that it is shiftable in the same direction (arrows A and B) as the first shifting stand 6 in a predetermined area. The third shifting stand 17 is so mounted that it is shiftable in the direction of arrows A and B by a ball screw 18 as shown in FIG. 2. A body 19 of the bore size trimming apparatus (hereinafter referred to as "apparatus body") is mounted on the third shifting stand 17. As shown in FIG. 3, a main shaft 20 is rotatably passed through the apparatus body 19. The main shaft 20 is rotated by a main shaft rotating motor 21 which is mounted on the apparatus body 19. A chuck 22 is attached to the tip of the main shaft 20 so that it is rotatable integrally to the shaft. An extended type lapping reamer 23 serving as a passing-through jig, which is a modification of the conventional extended type lapping reamer as shown in FIG. 9, is removably attached to the chuck 22. The extended type lapping reamer 23 is so adapted that a passing-through portion 23*a* to which super abrasive grain (diamond or CBN abrasive grain) is electrically applied is passed through the bore of the workpiece 9' grinding-machined by the grinding wheel 11 of the bore grinding machine 4 as described above.

The external size of the passing-through portion 23*a* of the extended type lapping reamer 23 can be variably controlled by the external size control device 24 so that it is larger than the bore size of the workpiece 9'.

The external size control device 24 includes an extension amount trimming shaft 25 which is rotatably passed through the inside of the main shaft 20, an extension amount trimming motor 26 for reversibly rotating the extension amount trimming shaft 25, an encoder 27, and an extension amount trimming piece 28 which is mounted in the passing-through portion 23*a* of the extended type lapping reamer 23, the extension amount trimming piece 28 being not rotatable by, for example, a key (not shown) and being reciprocatable in the axial direction. The extension amount trimming motor 26 and the encoder 27, which are coupled with the main shaft rotating motor 21, can be rotated by the motor 26.

In FIG. 3, a pulley 30 is fixed on the main shaft 20. A belt 29 is wound around the pulley 30. The rotating force of the main shaft rotating motor 21 is transmitted to the extension amount trimming motor 26 and encoder 27 through the belt 29 and pulley 30. A coupling 31 couples the extension amount trimming shaft 25 with the rotating shaft 26*a* of the extension amount trimming shaft motor 26. A sleeve 32 prevents the extension amount trimming shaft 25 from being swung. When the extension amount trimming shaft 25 is normally and reversely rotated by the extension amount trimming motor 26, the extension amount trimming piece 28 is reciprocated in an axial direction so that the extension amount of the external size of the passing-through portion 23a of the extended type lapping reamer 23 is automatically trimmed. The passing-through portion 23a of the extended type lapping reamer 23 is passed through the bore of the workpiece 9' grinding-machined by the grinding wheel 11 of the bore grinding machine 4 so that the bore size can be trimmed to about 1 to 2 μmϕ.

The bore size measuring device 15 has a fourth shifting stand 33 which is shiftable in a predetermined area on the second stand 3 in the same direction (direction of arrows A and B) as the first shifting stand 6. An after-gauge 34 is mounted on the fourth shifting stand 33. The after-gauge 34 operates to measure the bore size of the workpiece 9" which is trimmed in its bore size by the bore size trimming device 14 and transported by the workpiece transporting rail 13. The after-gauge 34 is provided with a needle-type micrometer (it may be provided with an air micrometer or the like). The bore size measured by the after-gauge 34 and the size instructed by a size instructing circuit 35 are fed to a comparison circuit 36. The bore size measured by the in-process gauge 12 is also fed to the comparison circuit 36. An output signal from the comparison circuit 36 is fed to the bore size control device 16. A control signal from the bore size control device 16 is fed to the bore grinding machine 4 and bore size trimming device 14, respectively. On the basis of the control signal, bore machining and bore size trimming are carried out.

The extension amount of the external size of the passing-through portion 23a of the extended type lapping reamer 23 is operated by the bore size control device 16 on the basis of the bore size measured by the in-process gauge 12 and the finishing setting size instructed by the bore size instructing circuit 35. On the basis of the operated value, the extension amount trimming motor 26 is controlled to shift the extension amount trimming piece 28 into a predetermined state for automatic trimming of the extension amount. The workpiece supplied by the workpiece transportation rail 13 is positioned to a predetermined position by a workpiece stopper (not shown).

An explanation will be given of the operation of the inner face grinder system 1 having the configuration described above. The workpiece 9, which rotates in a state where it is held at the holding portion of the workpiece head 8 of the bore size grinding machine, is ground by the grinding wheel 11 while its size is being managed by the in-process gauge 12.

The workpiece 9' resulting from completion of bore grinding by the bore grinding machine 4 is rollingly fed to the bore size trimming device 14 through the workpiece transportation rail 13 which is the subsequent step. In this bore size trimming device 14, the passing-through portion 23a of the rotating extended-type lapping reamer 23 is passed through the bore of the workpiece 9' by a single reciprocating shift in the direction of arrows A and B of the third shifting stand 17. Thus, the bore surface of the workpiece 9' is trimming-machined to a predetermined size. Upon completion of trimming the bore size by the bore size trimming device 14, the resultant workpiece 9" is rollingly fed to the bore size measuring device 15 which is a subsequent step through the workpiece transportation rail 13. In the bore size measuring device 15, the bore size of the workpiece 9" is measured by the after-gauge 34. The bore size control device 16 performs an operation on the basis of the bore size measured by the after-gauge 34 and the finishing setting size instructed by the bore size instructing circuit 35. On the basis of the operated value, the bore grinding machine 4 and bore size trimming device 14 are placed under feedback control. Thus, the grinding wheel 11 of the bore grinding machine 4 is controlled to adjust the amount of cutting, and the extension amount trimming motor 26 is controlled. Thus, the extension amount trimming piece 28 is shifted to a predetermined state so that the extension amount of the external size of the passing-through portion 23a of the extended type lapping reamer 23 is automatically adjusted and the bore size of the workpiece 9" is corrected to a finish setting size value. The workpiece 9" after correction is rollingly discharged to a predetermined position by the workpiece transportation rail 13. The reason why the passing-through portion 23a of the extended type lapping reamer 23 with the extension amount of the external diameter being variable is passed through the bore of the workpiece 9" is that adjustment is carried out when the external periphery of the passing-through portion 23a wears and the amount of correction is selected in accordance with the correction of 1 to 2 μmϕ of the workpiece 9".

In the first embodiment, the machining is carried out with tolerance of 3 μmϕ or less using the extended type lapping reamer tool to which super-abrasive is electrically applied. Smooth machining can be performed without scratching the workpiece due to the tool, and the bore size of the workpiece is determined by the diameter of the tool itself. Thus, the desired inner periphery can be finished with high accuracy.

The extension amount of the external diameter of the tool is automatically corrected on the basis of the value operated by the value measured by the in-process gauge or after-gauge of the inner face grinding system 1 and a desired setting size value. For this reason, a desired setting size can be obtained with high accuracy.

The grinder system according to the present invention, because of its simple structure, can be fabricated in a compact structure, and the bore size of the workpiece can be corrected with high accuracy without reducing the efficiency when added to the conventional grinder. The grinder system according to the present invention can be manufactured simply and at low cost with no requirement of introduction of an expensive honing machine and with no skill unlike the conventional apparatus. Therefore, the industrial value of the present invention is very high.

In accordance with the first embodiment, the final finishing size of the bore size of the workpiece can be assured as compared with the second embodiment described later.

Embodiment 2

Figure 4:
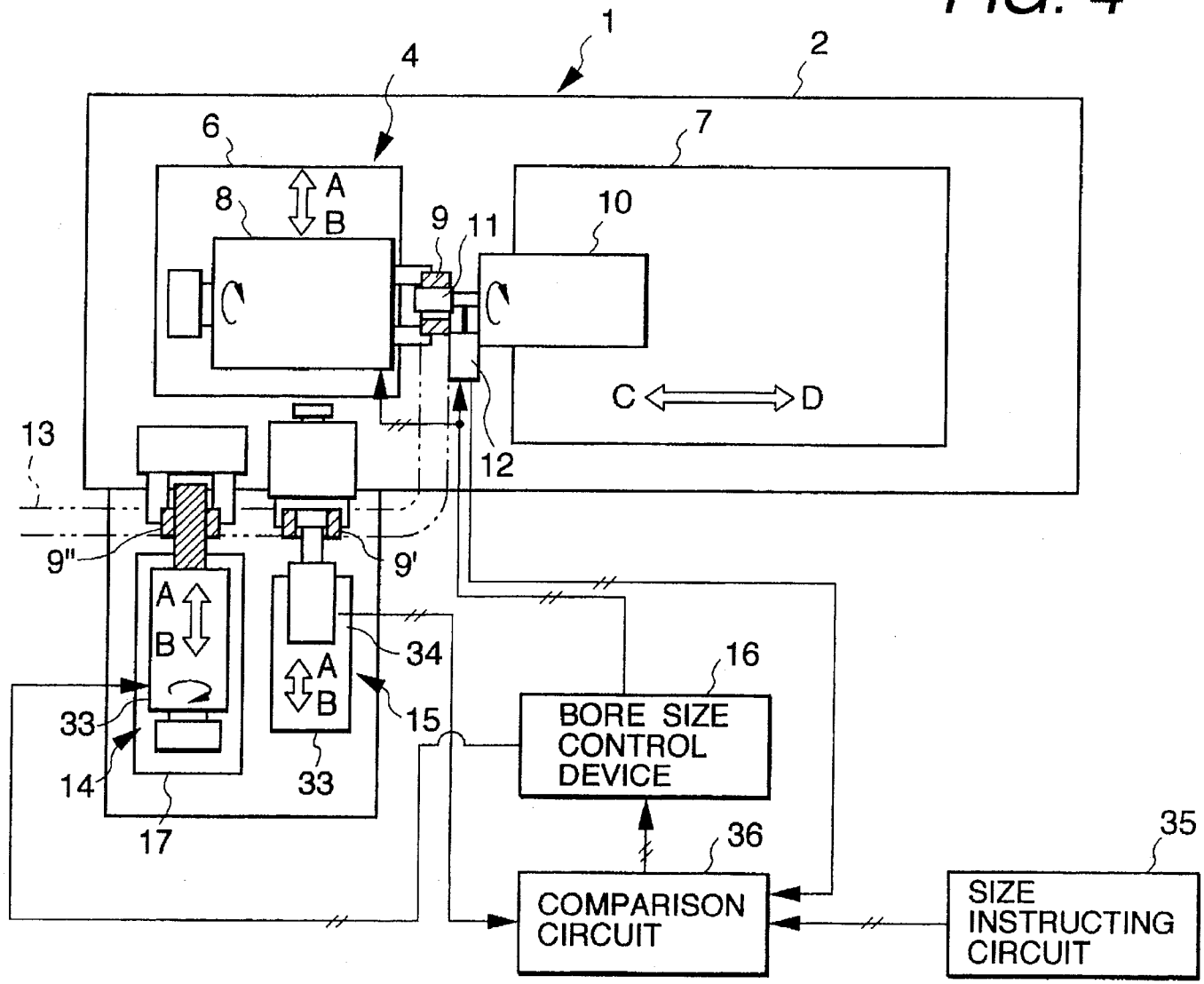
FIG. 4 is a block diagram showing a configuration of a bore surface grinder system equipped with a bore size correcting apparatus according to a second embodiment of the present invention.

Referring to FIG. 4, an explanation will be given of a second embodiment of the present invention. FIG. 4 is a block diagram showing the configuration of an internal surface grinder system 1 provided with the bore size correcting apparatus according to the second embodiment of the present invention. In FIG. 4, like reference numerals refer to like parts in FIG. 1 showing the first embodiment. FIG. 4 is different from FIG. 1 in the positions where the bore size trimming device 14 and bore size measuring device 15 are located. In the first embodiment, the workpiece was caused to flow in the sequential order of the bore grinding machine 4, bore size trimming device 14, and bore size measuring device 15. On the other hand, in the second embodiment, the workpiece is caused to flow in the sequential order of the bore grinding machine 4, bore size measuring device 15, and bore size trimming device 14.

In the second embodiment, the bore surface of the workpiece 9 is grinding-machined by the bore grinding machine 4. The workpiece 9' resulting from completion of the bore machining is rollingly fed by the workpiece transportation rail 13 to the bore size measuring device which is a subsequent step. The bore size of the workpiece 9' is measured by the after-gauge 34 of the bore size measuring device 15. The workpiece 9" resulting from completion of the bore size measurement is rollingly fed by the workpiece transportation rail 13 to the bore size trimming device 14 which is a subsequent step.

The bore size control device 16 performs an operation based on the bore size instructed by the after-gauge 34 and the finish setting size measured by the size instructing circuit 35. On the basis of the operated value, the bore grinding machine 4 and the bore size trimming device 14 are placed under the feedback control. Thus, the grinding wheel 11 of the bore grinding machine 4 is controlled to adjust the amount of cutting, and the extension amount trimming motor 26 is controlled. Thus, the extension amount piece 28 is shifted to a predetermined state so that the extension amount of the external size of the passing-through portion 23*a* of the extended type lapping reamer 23 is automatically adjusted and the bore size of the workpiece 9" is corrected to a finish setting size value. The workpiece 9" after correction is rollingly discharged to a predetermined position by the workpiece transportation rail 13.

The second embodiment has the same effect as that of the first embodiment. The second embodiment has high adaptability to the feedback control of the bore grinding machine as compared with the first embodiment.

Embodiment 3

Figure 5:
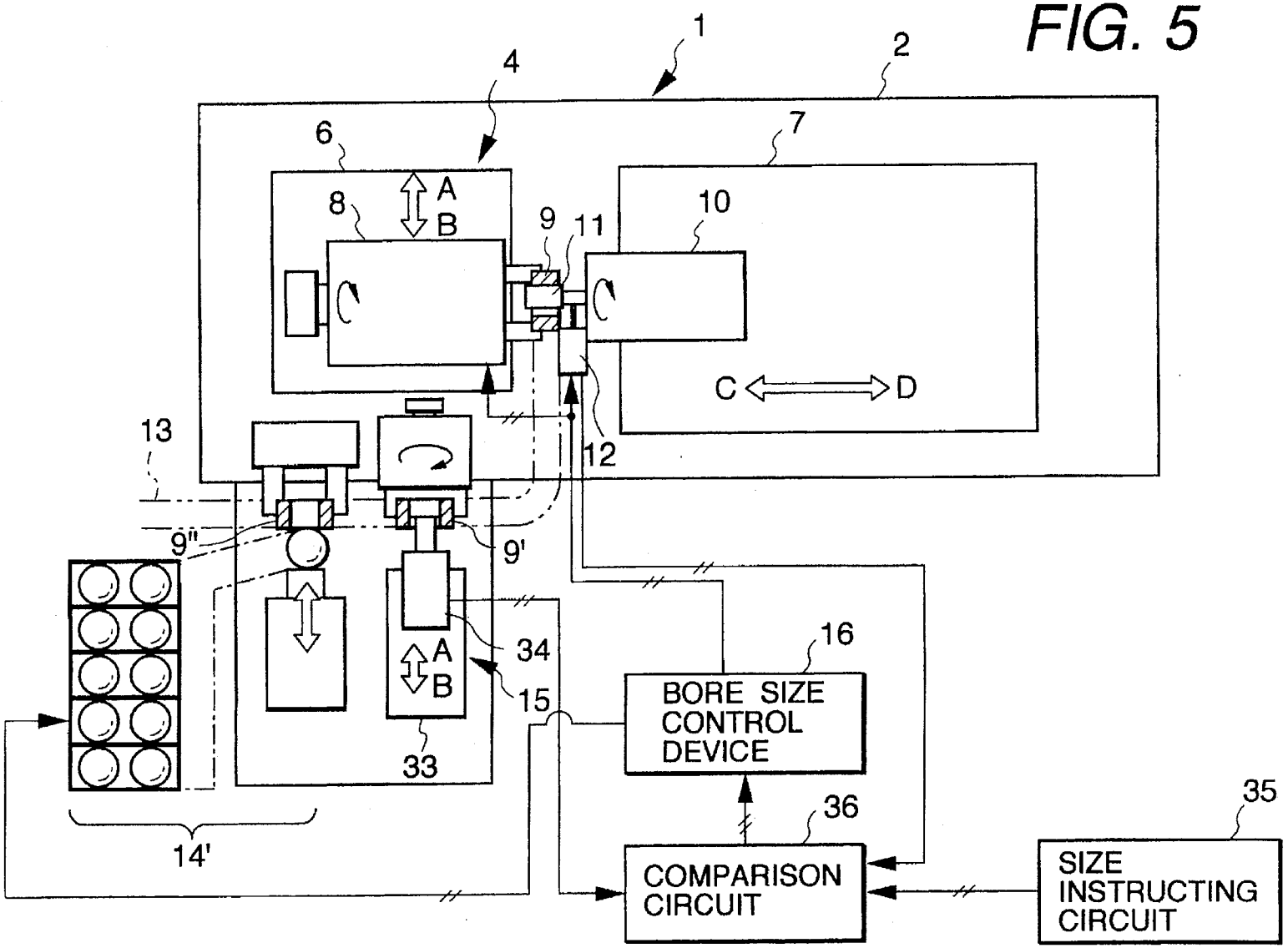
FIG. 5 is a block diagram showing a configuration of a bore surface grinder system equipped with a bore size correcting apparatus according to a third embodiment of the present invention.
Figure 6:
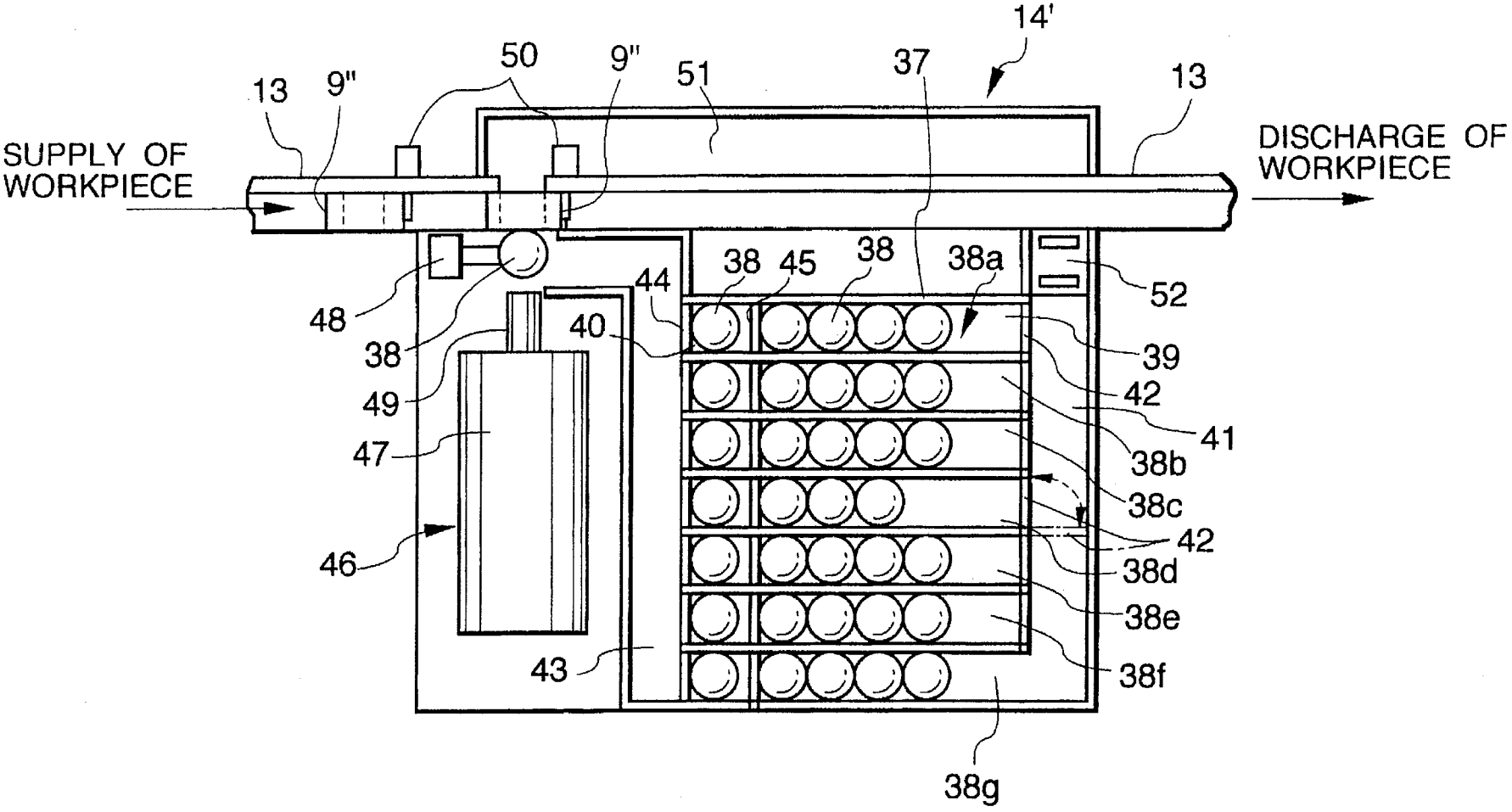
FIG. 6 is a plan view showing the configuration of the bore size correcting apparatus shown in FIG. 5.

Referring to FIGS. 5 and 6, an explanation will be given of a third embodiment of the present invention. FIG. 5 is a block diagram showing the configuration of an internal surface grinder system 1 provided with the bore size correcting apparatus according to the third embodiment of the present invention. In FIG. 5, like reference numerals refer to like parts in FIG. 4 showing the second embodiment. FIG. 5 is different from FIG. 4 in the structure of the bore size trimming device.

Accordingly, in the first and second embodiments, the reamer type variable passing-through jig was passed through the bore of the workpiece, while in the third embodiment, a bore size trimming device 14' uses a ball circulating type variable jig as a jig to be passed through the bore of the workpiece.

The bore size trimming device 14' has a ball stocker 37 as shown in FIG. 6. The ball stocker 37 has a plurality (seven in the third embodiment) of ball chambers 38*a*, 38*b*, 38*c*, 38*d*, 38*e*, 38*f* and 38*g* which store a large number of burnishing balls having predetermined sizes classified by size and previously prepared. Namely, a predetermined number (five in the third embodiment) of burnishing balls laving the same external diameter within tolerance of e.g., ±0.3 μm are arranged in each ball chamber. The external diameter of the ball is made larger (e.g., +1 μm) than the finishing size. In the order from the ball chamber 38*a* to 38*g*, the balls received have gradually increasing sizes. One end of each of the ball chambers 38*a* to 38*g* is used as a ball inlet 39 while the other end thereof is used as a ball outlet 40. Each of the ball chambers 38*a* to 38*g* is sloped to become gradually low from the ball inlet 39 to the ball outlet 40.

The ball inlet 39 of each of the ball chambers 38*a* to 38*g* is communicated with a ball return path 41 which is sloped to become gradually low from the upper end to the lower end of FIG. 6. As seen from the figure, the ball inlet 39 of each of the ball chambers 38*a* to 38*f* other than the ball chamber 38*g* at the lowest end is equipped with a ball collection door 44 so that it is rotatable. The ball collection door 42 usually closes the ball inlet 39 as indicated by solid line. When the burnishing ball returns on the ball return path 41, the ball collecting door 42 of the ball chamber to which the burnishing ball is to enter opens, thus resulting in a state as indicated by two-dot chain line. Thus, the burnishing ball 38 is received by the ball collecting door 42 so that it is automatically held in a predetermined ball chamber.

The ball outlet 40 of each of the ball chambers 38*a* to 38*g* is communicated with a ball supply path 43 which is sloped to become gradually low from the lower end to the upper end of FIG. 6. As seen from the figure, the ball outlet 39 of each of the ball chambers 38*a* to 38*g* at the lowest end is equipped with a ball supply shutter 44 so that it is rotatable. The ball supply shutter 44 usually closes the ball outlet 40 as indicated by a solid line. When the ball supply shutter 44 opens as necessity requires, the burnishing ball 38 in each of the ball chambers 38*a* to 38*g* can be supplied to the ball supply path 43.

In the neighborhood of the ball outlet 40 in each of the ball chambers 38*a* to 38*g*, a ball distributing shutter 45 is mounted openably or closeably. The ball distributing shutter 45 is opened or closed so that one burnishing ball 38 is located at the position of the ball outlet 40 so that the burnishing balls 38 are supplied to the ball supply path 43 one by one.

A ball passing-through device 46 passes the burnishing ball supplied to the ball supply path 43 through the bore of the workpiece 9" whose bore size is measured by the after-gauge 34 of the bore size measuring device 15. The ball passing-through device 46 has a cylinder 47 which operates by fluid pressure such as oil pressure or air pressure. The burnishing ball 38 supplied to the ball supply path 43 and positioned by the ball stopper 48, when it is pushed by a piston rod 49 passed through the cylinder 47, is passed through the bore of the workpiece 9" so that the bore size of the workpiece 9" is collected to the finishing size value. The workpiece 9" is delivered by the workpiece transportation rail 13 and positioned at a predetermined position by a workpiece stopper 50.

The burnishing ball 34, after it is passed through the bore of the workpiece 9", travels in a ball collecting path 51 which is sloped from the left end to the right end of the figure and is lifted by a conveyer 52. As a result, the burnishing ball returns into the ball return path 41 so that it is received in a predetermined ball chamber. Thus, the burnishing balls 38 can be used repeatedly until its lifetime.

An explanation will be given of the inner face grinder system 1 having the configuration described above.

In the third embodiment, the bore surface of the workpiece 9 is grinding-machined by the bore grinding machine 4. The workpiece 9' resulting from completion of the bore machining is rollingly fed by the workpiece transportation rail 13 to the bore size measuring device 15 which is a subsequent step. The bore size of the workpiece 9' is measured by the after-gauge 34 of the bore size measuring device 15. The workpiece 9" resulting from completion of the bore size measurement is rollingly fed by the workpiece transportation rail 13 to the bore size trimming device 14' which is a subsequent step. The workpiece 9" can be positioned at a predetermined position by a workpiece stopper 51.

An operation based on the bore size measured by the after-gauge 34 and the finish setting size instructed by the size instructing circuit 35 is performed by the bore size control device 16. On the basis of the operated value, the bore grinding machine 4 and the bore size trimming device 14 are placed under the feedback control. Thus, the grinding wheel 11 of the bore grinding machine 4 is controlled to adjust the amount of cutting. The burnishing ball having a size suitable for the workpiece 9" at issue from the ball chambers 38*a* to 38*f* is selected. As a result, the ball supplying shutter 44 of the ball chamber in which the selected burnishing ball 38 is received opens. Subsequently, the selected burnishing ball 38 is supplied into the ball supplying path 43 so that it abuts on a ball stopper 48 so as to be located at a predetermined position. The burnishing ball 38 thus located is pushed by the piston rod 49 so that it is passed through the workpiece 9". Thus, the bore size of the workpiece 9" is corrected to the finish-setting size. The workpiece 9" after correction is rollingly discharged to a predetermined position by the workpiece transportation rail 13.

The burnishing ball 38 which has been passed through the bore of the workpiece 9" travels in a ball collecting path 51, and returns to the ball returning path 41 by a conveyer 52. The ball collecting door of the ball chamber in which the burnishing ball 38 is received opens so that the burnishing ball 38 is received by the ball collecting door 42 and collected in the corresponding ball chamber.

In the third embodiment, the reason why the burnishing ball 38 having a predetermined size is selected from a large number of burnishing balls having different sizes so that it is passed through the bore of the workpiece 9" is that the adjustment is carried out when the external periphery of the burnishing ball 38 wears and the amount of correction is selected in accordance with the correction of 1 to 2 μmϕ of the bore of the workpiece 9" as in the case of the extended type lapping reamer 23 in the first and second embodiment.

In the third embodiment, by selecting a burnishing ball having a suitable size which is operated from the values of the ground-bore size and finish-setting size, ball burnishing is performed to finish the bore of the workpiece with high accuracy.

The grinder system according to the present invention, because of its simple structure, can be fabricated in a compact structure, and the bore size of the workpiece can be corrected with high accuracy without reducing the efficiency when added to the conventional grinder. The grinder system according to the present invention can be manufactured simply and at low cost with no requirement of introduction of an expensive honing machine and with no skill unlike the conventional apparatus. Therefore, the industrial value of the present invention is very high.

The bore size trimming device according to the present invention is simple in structure as compared with the first and second embodiments because an inexpensive and accurate burnishing ball can be used.

Embodiment 4

Figure 7:
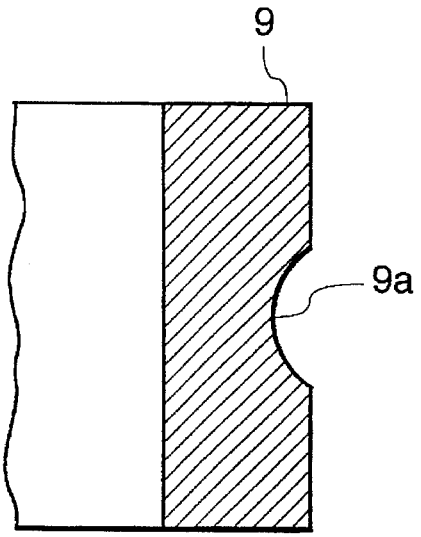
FIG. 7 is a half-broken sectional view of the workpiece machined by the bore size correcting apparatus according to a fourth embodiment of the present invention.
Figure 8:
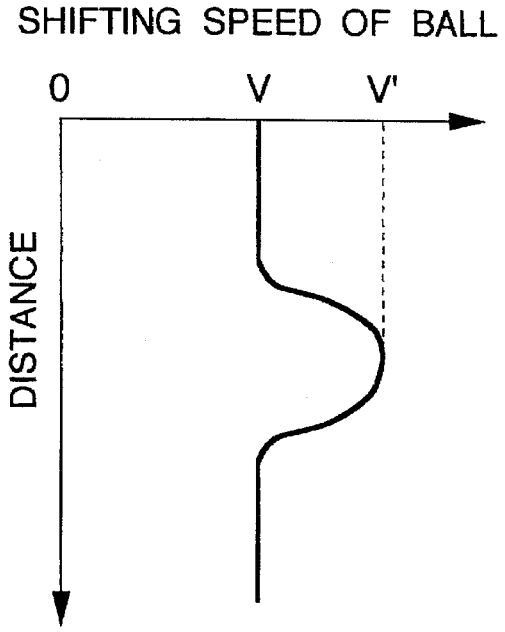
FIG. 8 is a graph showing the shifting speed of a burnishing ball which is passed through the bore surface of the workpiece.

Referring to FIGS. 7 and 8, an explanation will be given of a fourth embodiment of the present invention. In the third embodiment, the wall thickness of the workpiece was uniform wholly in an axial direction. For this reason, the burnishing ball 38 was passed through the bore of the workpiece at a constant shifting speed under the pressure by the piston rod 49. On the other hand, where the wall thickness of the workpiece is not uniform wholly in the axial direction as shown in FIG. 7, the shifting speed of the burnishing ball 38 can be program-controlled so that it is higher at the thinner wall portion of the workpiece, thereby correcting the bore size of the workpiece.

FIG. 7 is a half-sectional view of the workpiece 9 having a circular groove 9*a* at an intermediate portion of the outer periphery in an axial direction. FIG. 8 is a graph showing the shifting speed of the burnishing ball. In FIG. 8, the ordinate represents a distance while the abscissa represents a shifting speed of the burnishing ball. FIG. 8 illustrates that the shifting speed of the burnishing ball 38 is changed from V to V' at the portion of the circular groove 9*a* of the workpiece 9, i.e., thin wall portion thereof, and remains V at the other portion.

The fourth embodiment provides the same advantage as in the third embodiment, and can effectively prevent the shape of the workpiece made of some material from being deformed because of various distribution of elastic and plastic areas due to differences in the wall thickness of the workpiece 9. It should be noted that the elasticity/plasticity (relation between deforming force and distortion) is a function of time.

Embodiment 5

In the third embodiment, the workpiece 9 and burnishing ball 38, except the conveyer 52, were transported by rolling due to their own weight using a slope. On the other hand, in a fifth embodiment, in order to transport the workpiece 9 and burnishing ball 38 smoothly, a lubricant is caused to flow through the transportation path.

Embodiment 6

In the third embodiment, the workpiece 9 and burnishing ball 38, except the conveyer 52, were transported by rolling due to their own weight using a slope. On the other hand, in a sixth embodiment, in order to transport the workpiece 9 and the burnishing ball 38 securely, a conveyer and cylinder mechanism are provided at a predetermined area of the transportation path so that the workpiece 9 and burnishing ball 38 can be forcibly transported.

As described above, according to the present invention, the bore size correcting apparatus can precisely finish the bore surface of the workpiece roughly manufactured by grinding, with no skill, so as to have any optional preset value, and can be made compact and inexpensive.

What is claimed is:

1. A bore surface grinder system for grinding a workpiece comprising, a bore grinding machine including a workpiece head rotatably supporting the workpiece, a machining tool for machining a bore surface of the workpiece, a tool head supporting the machining tool, and an in-process fixed-size controlling device for controlling a bore size of the workpiece while relatively shifting the workpiece head and the tool head in radial and axial directions of the workpiece; and a bore size correcting apparatus for correcting the bore size of the workpiece machined by the bore grinding machine, and comprising:

a trimming device including a passing-through jig passing through the bore surface of the workpiece machined by the bore grinding machine, for trimming the bore size of the workpiece, the passing-through jig including an external diameter control device varying an external diameter of the jig to be made larger than the bore size of the workpiece;

a measuring device for measuring one of the bore size to be corrected and a corrected bore size of the workpiece and outputting a signal in accordance with the measured bore size; and a control device for supplying a machining command to at least one of the in-process fixed-size control device and the external diameter control device in accordance with the signal from the measuring device;

wherein the trimming device operates on the workpiece transported from the bore grinding machine prior to the measuring device.

2. The bore surface grinder system of claim 1, wherein the trimming device comprises a variable passing-through jig selected from a reamer type and a ball circulating type.

3. The bore surface grinder system of claim 2, wherein the variable passing-through jig comprises a plurality of burnishing balls that pass through the bore surface of the workpiece and have a predetermined diameter, and wherein a shifting speed of the burnishing balls varies in accordance with a thickness of a wall of the workpiece.

4. A bore surface grinder system for grinding a workpiece comprising, a bore grinding machine including a workpiece head rotatably supporting the workpiece, a machining tool for machining a bore surface of the workpiece, a tool head supporting the machining tool, and an in-process fixed-size controlling device for controlling a bore size of the workpiece while relatively shifting the workpiece head and the tool head in radial and axial directions of the workpiece; and a bore size correcting apparatus for correcting the bore size of the workpiece machined by the bore grinding machine, and comprising:

a trimming device including a passing-through jig passing through the bore surface of the workpiece machined by the bore grinding machine, for trimming the bore size of the workpiece, the passing-through jig including an external diameter control device varying an external diameter of the jig to be made larger than the bore size of the workpiece;

a measuring device for measuring one of the bore size to be corrected and a corrected bore size of the workpiece and outputting a signal in accordance with the measured bore size; and a control device supplying a machining command to at least one of the in-process fixed-size control device and the external diameter control device in accordance with the signal from the measuring device;

wherein the measuring device operates on the workpiece transported from the bore grinding machine prior to the trimming device.

5. The bore surface grinder system of claim 4, wherein the trimming device comprises a variable passing-through jig selected from a reamer type and a ball circulating type.

6. The bore surface grinder system of claim 5, wherein the variable passing-through jig comprises a plurality of burnishing balls that pass through the bore surface of the workpiece and have a predetermined diameter, and wherein a shifting speed of the burnishing balls varies in accordance with a thickness of a wall of the workpiece.

7. A bore surface grinder system for grinding a workpiece comprising, a bore grinding machine including a workpiece head rotatably supporting the workpiece, a machining tool for machining a bore surface of the workpiece, a tool head supporting the machining tool, and an in-process fixed-size controlling device for controlling a bore size of the workpiece while relatively shifting the workpiece head and the tool head in radial and axial directions of the workpiece; and a bore size correcting apparatus for correcting the bore size of the workpiece machined by the bore grinding machine, and comprising:

a trimming device including a passing-through jig passing through the bore surface of the workpiece machined by the bore grinding machine, for trimming the bore size of the workpiece, the passing-through jig including an external diameter control device varying an external diameter of the jig to be made larger than the bore size of the workpiece;

a measuring device for measuring one of the bore size to be corrected and a corrected bore size of the workpiece and outputting a signal in accordance with the measured bore size; and a control device for supplying a machining command to at least one of the in-process fixed-size control device and the external diameter control device in accordance with the signal from the measuring device wherein the trimming device comprises a variable passing-through jig selected from a reamer type and a ball circulating type.

8. The bore surface grinder system of claim 7, wherein the variable passing-through jig comprises a plurality of burnishing balls that pass through the bore surface of the workpiece and have a predetermined diameter, and wherein a shifting speed of the burnishing balls varies in accordance with a thickness of a wall of the workpiece.

* * * * *